US010138697B2

(12) United States Patent
Guidry

(10) Patent No.: US 10,138,697 B2
(45) Date of Patent: Nov. 27, 2018

(54) MINERAL EXTRACTION SYSTEM HAVING MULTI-BARRIER LOCK SCREW

(75) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 1600 days.

(21) Appl. No.: 12/937,538

(22) PCT Filed: May 12, 2009

(86) PCT No.: PCT/US2009/043646

§ 371 (c)(1),
(2), (4) Date: Oct. 12, 2010

(87) PCT Pub. No.: WO2009/154901

PCT Pub. Date: Dec. 23, 2009

(65) Prior Publication Data

US 2011/0024108 A1 Feb. 3, 2011

Related U.S. Application Data

(60) Provisional application No. 61/074,563, filed on Jun. 20, 2008.

(51) Int. Cl.
*E21B 33/03* (2006.01)
*E21B 33/04* (2006.01)

(52) U.S. Cl.
CPC ..... *E21B 33/03* (2013.01); *E21B 33/04* (2013.01)

(58) Field of Classification Search
CPC ..... E21B 33/03; E21B 33/04
USPC ..... 166/250.01, 250.08, 379, 378, 75.11, 166/92.1, 75.13
See application file for complete search history.

(56) References Cited

U.S. PATENT DOCUMENTS

| | | | | |
|---|---|---|---|---|
| 3,043,371 | A * | 7/1962 | Rector | 166/97.1 |
| 3,739,846 | A * | 6/1973 | Beson | 166/89.2 |
| 3,965,977 | A * | 6/1976 | Beson | 166/88.4 |
| 4,181,175 | A * | 1/1980 | McGee et al. | 166/88.4 |
| 4,281,679 | A * | 8/1981 | Stearns | 137/515.5 |
| 4,407,171 | A * | 10/1983 | Hasha et al. | 73/46 |
| 4,553,776 | A * | 11/1985 | Dodd | 285/212 |
| 4,556,224 | A | 12/1985 | Le | |
| 4,650,225 | A | 3/1987 | Le et al. | |
| 4,718,679 | A | 1/1988 | Vyvial | |
| 4,919,459 | A | 4/1990 | Miller | |

(Continued)

OTHER PUBLICATIONS

PCT Search Report and Written Opinion of PCT Application No. PCT/US2009/043646 dated Jan. 28, 2010.

(Continued)

*Primary Examiner* — Caroline N Butcher
(74) *Attorney, Agent, or Firm* — Fletcher Yoder, P.C.

(57) ABSTRACT

A dual barrier lock screw for a wellhead assembly is provided that includes a first seal disposed at a first axial location along the body of the screw and a second seal disposed at a second axial location along the body of the screw, wherein the first and second axial locations are different from one another. The screw may also include a passage extending axially through the body of the screw and coupled to a port at the end of the screw. The port is configured to receive external pressure and allow testing of the dual barrier seals of the lock screws. A system that includes the lock screw and methods of operating and testing the lock screw are also provided.

34 Claims, 5 Drawing Sheets

(56) References Cited

U.S. PATENT DOCUMENTS

| | | | | | |
|---|---|---|---|---|---|
| 5,044,602 | A | | 9/1991 | Heinonen | |
| 5,257,792 | A | * | 11/1993 | Putch et al. | 277/328 |
| 5,730,473 | A | * | 3/1998 | Wilkins et al. | 285/26 |
| 5,749,608 | A | * | 5/1998 | Wilkins et al. | 285/123.12 |
| 5,833,490 | A | * | 11/1998 | Bouldin | 439/462 |
| 6,056,327 | A | * | 5/2000 | Bouldin et al. | 285/93 |
| 6,470,971 | B1 | * | 10/2002 | Bridges | 166/379 |
| 6,715,555 | B2 | * | 4/2004 | Milberger et al. | 166/368 |
| 7,219,736 | B1 | * | 5/2007 | Levy | 166/336 |
| 7,784,838 | B2 | * | 8/2010 | Levy | 285/342 |
| 8,037,933 | B1 | * | 10/2011 | Levy | 166/242.3 |
| 2007/0096465 | A1 | * | 5/2007 | Hall et al. | 285/342 |
| 2011/0024108 | A1 | | 2/2011 | Guidry | |

OTHER PUBLICATIONS

UK Examination Report for UK Application No. GB1212322.0; dated Aug. 24, 2012.
UK Examination Report for UK Application No. GB1100866.1; dated Feb. 28, 2012.
UK Examination Report for UK Application No. GB1100866.1; dated Sep. 10, 2012.

* cited by examiner

MINERAL EXTRACTION SYSTEM HAVING MULTI-BARRIER LOCK SCREW

CROSS-REFERENCE TO RELATED APPLICATIONS

This application claims priority to and benefit of PCT Patent Application No. PCT/US2009/043646, entitled "Mineral Extraction System Having Multi-Barrier Lock Screw," filed May 12, 2009, which is herein incorporated by reference in its entirety, and which claims priority to and benefit of U.S. Provisional Patent Application No. 61/074,563, entitled "Mineral Extraction System Having Multi-Barrier Lock Screw", filed on Jun. 20, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations. Additionally, such wellhead assemblies may also include components, such as an isolating mandrel ("frac mandrel") and/or fracturing tree, to facilitate a fracturing process.

Resources such as oil and natural gas are generally extracted from fissures or other cavities formed in various subterranean rock formations or strata. A fracturing process (i.e., "frac" process) may be used to create one or more man-made fractures in a rock formation, such that such that a connection can be made with a number of these pre-existing fissures and cavities. In this manner, the fracturing process enables oil, gas, or the like to flow from multiple pre-existing fissures and cavities to the well via the man-made fractures. Such fracturing processes typically include injecting a fluid into the well to form the man-made fractures. These "frac" wells may include relatively high pressures so that when changing the components of the wellhead, such as the "Christmas" tree or installing a tubing hanger and production tubing, it may be desirable to have additional safety measures in the wellhead assembly. The frac mandrel or the production tree may include the use of "dual barriers" to provide seals during or after the fracturing process or during production flow. However, these dual barriers are only present when such equipment is installed and do not provide for testing the seal integrity of the components of the wellhead assembly.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
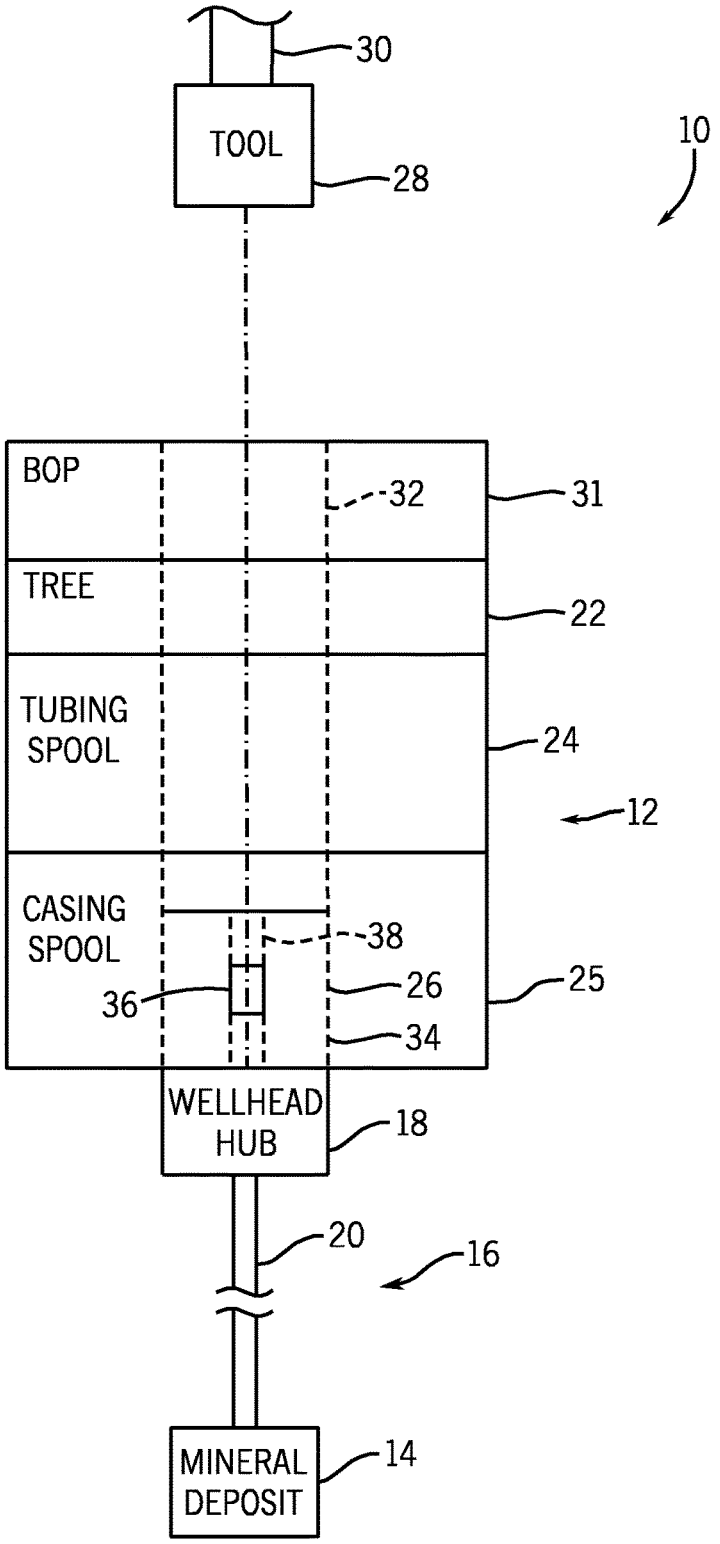
FIG. 1 is a block diagram that illustrates a mineral extraction system according to an embodiment of the present invention.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead assembly 12 coupled to a mineral deposit 14 via a well 16, wherein the well 16 includes a wellhead hub 18 and a well-bore 20. The wellhead hub 18 generally includes a large diameter hub that is disposed at the termination of the well-bore 20. The wellhead hub 18 provides for the connection of the wellhead assembly 12 to the well 16.

The wellhead assembly 12 typically includes multiple components that control and regulate activities and conditions associated with the well 16. For example, the wellhead assembly 12 generally includes bodies, valves and seals that route produced minerals from the mineral deposit 14, provide for regulating pressure in the well 16, and provides for the injection of chemicals or fluids into the well-bore 20 (e.g., down-hole), such as during a fracturing process. In the illustrated embodiment, the wellhead assembly 12 includes what is colloquially referred to as a Christmas tree 22 (hereinafter, a tree), a tubing spool 24, a casing spool 25, and a hanger 26 (e.g., a tubing hanger or a casing hanger). The system 10 may include other devices that are coupled to the wellhead assembly 12, and devices that are used to assemble and control various components of the wellhead assembly 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead assembly 12. In other embodiments, such as surface systems, the tool 28 may include a device suspended over and/or lowered into the wellhead assembly 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (e.g., down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead assembly 12 and/or the tree 22 before being routed to shipping or storage facilities. A blowout preventer (BOP) 31 may also be included, either as a part of the tree 22 or as a separate device. The BOP may consist of a variety of valves, fittings and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and worker procedures. For example, components can be run down to the wellhead assembly 12 and disposed in the tubing spool bore 34 to seal-off the well bore 20, to inject chemicals down-hole, to suspend tools down-hole, to retrieve tools down-hole, and the like.

The well bore 20 generally contains elevated pressures. For example, the well bore 20 may include pressures that exceed 10,000 pounds per square inch (PSI), that exceed 15,000 PSI, and/or that even exceed 20,000 PSI. Accordingly, the mineral extraction system 10 employs various mechanisms, such as seals, plugs and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead assembly 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. The tubing hanger 26 may be suspended in the tubing spool 24 or the casing spool 36 via one or more lock screws that insert through the spool 24 or 36 and engage the tubing hanger 26.

In some embodiments, the various components of the mineral extraction system 10 may include a sealing structure described as "dual barrier," e.g., having two seals to provide sealing redundancy. Such a system may be referred to as a "dual barrier time saver" (DBTS) system.

In an exemplary embodiment of the present invention, the lock screws described above that secure and bias downward a tubing hanger 26 or other components may provide two seals, i.e., a dual barrier, to provide redundant sealing further resistant to high pressures during or after a fracturing process or production. The lock screws may provide a testing port so that seal integrity against the wellhead assembly may be tested.

Figure 2:
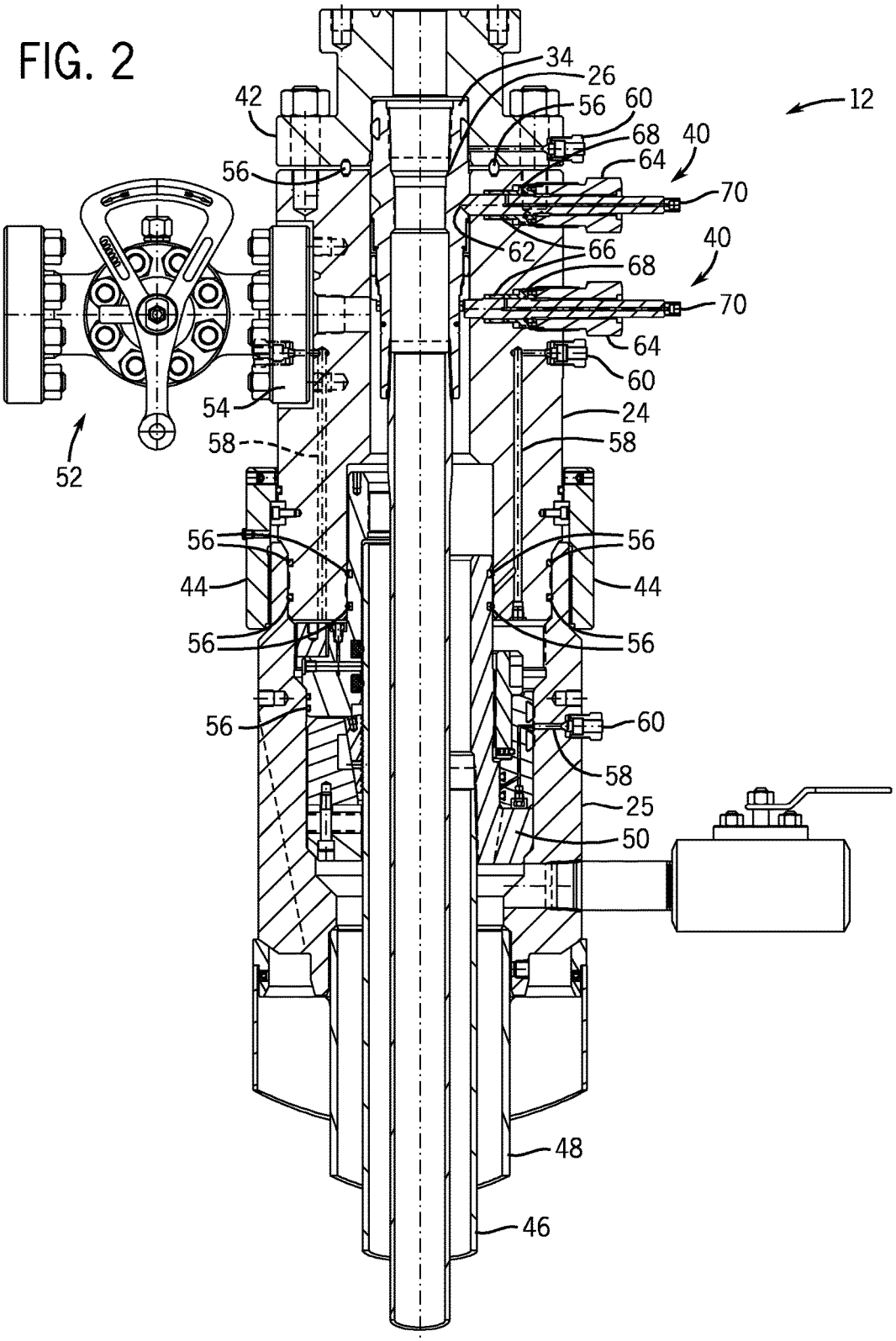
FIG. 2 is a cross-section of a wellhead assembly with tubing and dual barrier lock screws in accordance with an embodiment of the present invention.

FIG. 2 is a schematic view of the wellhead assembly 12 having dual barrier lock screws 40 in accordance with an embodiment of the present invention. The wellhead assembly 12 includes the tubing hanger 26 disposed in the tubing spool bore 34 of the tubing spool 24. The tubing spool 24 may be coupled to other components of the wellhead assembly 12, such as a tree or blowout preventer, by an adapter flange 42. In the presently illustrated embodiment, the tubing spool 24 is coupled to the casing spool 25 via a union nut 44, which is threaded onto the casing spool 25. In other embodiments, wellhead components, such as the tubing spool 24, may be coupled to the casing spool 25 in any suitable manner, including through the use of various other connectors, collars, or the like. The wellhead assembly 12 also includes a production casing 46, which may be suspended within the casing spool 25 and a surface casing 48 via a casing hanger 50. It will be appreciated that a variety of additional components may be coupled to the casing spool 25 to facilitate production from the well 16.

A valve assembly 52 is coupled to the tubing spool 24 via a flange 54, and may serve various purposes, including releasing pressure from the tubing head 24. The internal bore 34 of the tubing spool 24 is configured to receive one or more additional wellhead members or components. The exemplary wellhead assembly 12 includes various seals 56 (e.g., annular or ring-shaped seals) to isolate pressures within different sections of the wellhead assembly 12. For instance, as illustrated, such seals 56 include seals disposed between the casing spool 25 and the casing hanger 50 and between the casing spool 25 and the tubing spool 24. Further, various components of the wellhead assembly 12, such as the tubing spool 24, may include internal passageways 58 that enable testing of one or more of the seals 56. When not being used for such testing, these internal passageways 58 may be sealed from the exterior via pressure barriers 60.

As depicted in FIG. 2, the lock screws 40 may extend through the tubing spool 24 and engage interior components of the wellhead assembly 12. The illustrated tubing hanger 26 mates with a generally frustoconical distal portion 62 of the lock screws 40, and the lock screws 40 are provided to compress and maintain the tubing hanger 26. To engage the tubing spool 24 and the tubing hanger 26, a gland 64 of the lock screws 40 is rotated to drive the distal portion 62 radially inward into engagement with the tubing hanger 26.

Each of the lock screws 40 may include a first seal 66 and a second seal 68 (e.g., annular seal) that provide a "dual barrier" system with the components of the wellhead assembly, such as the tubing spool 24. Thus, the first seal 66 and the second seal 68 each individually provide a seal against the tubing spool 24, providing a redundant sealing mechanism and increasing the safety of the wellhead assembly 12. The seals 66 and 68 may be formed from nitrile, graphite, or any other suitable sealing material. Additionally, if the tubing hanger 26 is set in tension, the lock screws 40 allow full bore tension with dual barriers provided by the first seal 66 and the second seal 68. In other embodiments, a "multi-barrier" system may be provided that includes 2, 3, 4, 5, or more seals.

Each of the lock screws 40 may also include a test port 70 that enables pressure testing of the lock screw 40, the first seal 66, and the second seal 68. For example, a hydraulic pump may be coupled to the test port 70. By applying pressure via the hydraulic pump, the integrity of the first seal 66 and the second seal 68 may be verified. Further, by providing each lock screw 40 with a test port 70, each lock screw 40 may be individually tested to verify seal integrity.

Figure 3:
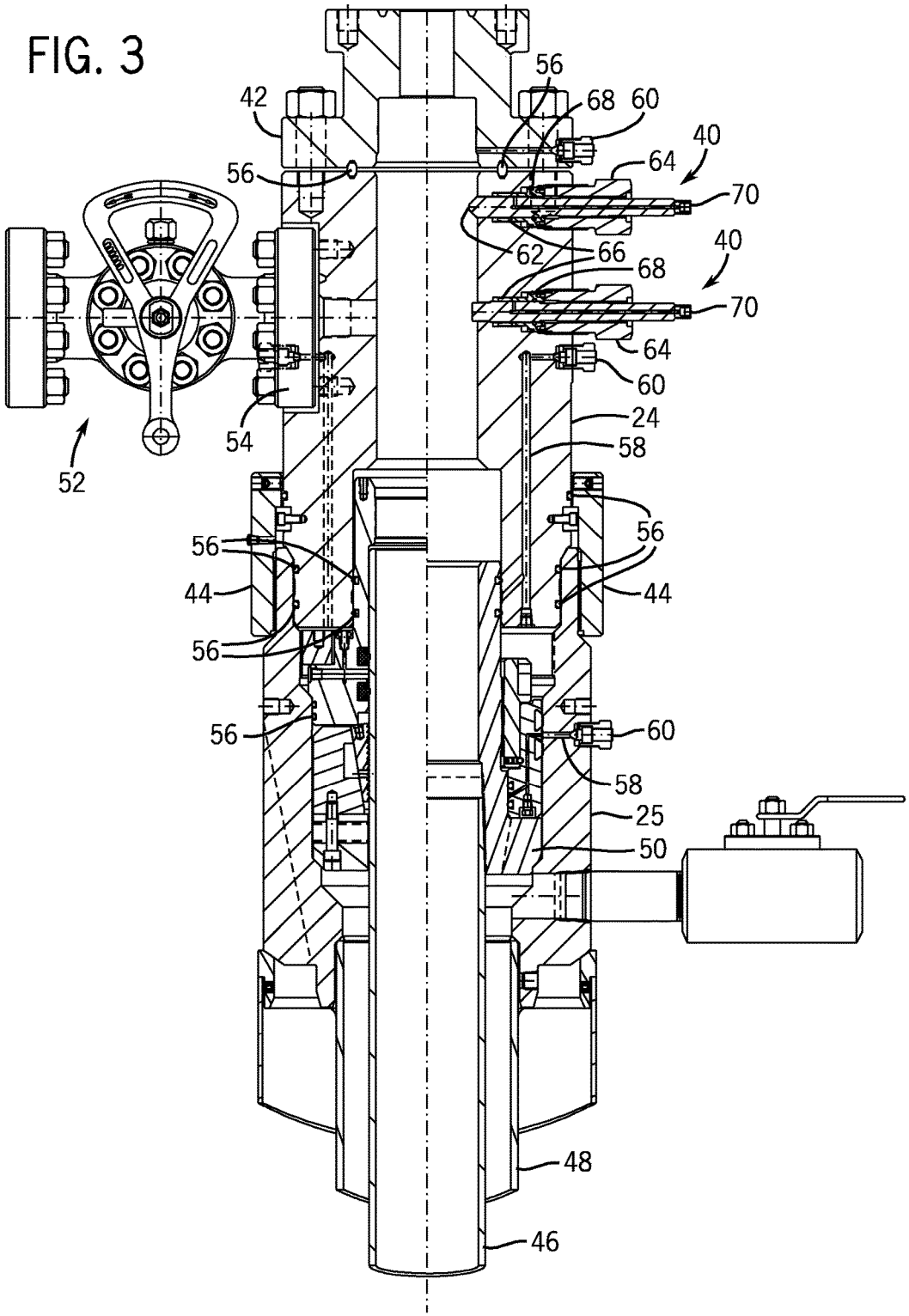
FIG. 3 is a cross-section of a wellhead assembly with dual barrier lock screws and without tubing in accordance with an embodiment of the present invention.

FIG. 3 illustrates a cross-section of the wellhead assembly 12 without the tubing hanger 26 but retaining the lock screws 40 in accordance with an embodiment of the present invention. The embodiment depicted in FIG. 3 may illustrate operation of the well 10 during or after the fracturing process and before tubing is run into the wellhead assembly 12. During this period of operation, the well may be flowed for a short period of time without the tubing hanger 26 or production tubing, exposing the tubing spool 24 and the lock screws 40 to elevated pressures. Advantageously, the first seal 66 and the second seal 68 of the lock screws 40 also provide a dual barrier during this production flow, increasing the safety and reliability of the wellhead assembly 12, thus providing a dual barrier at all stages of operation of the wellhead assembly 12. Thus, the sealing provided by the lock screws 40 and the first and second seals 66 and 68 provide a dual barrier throughout the life of the well, such as during fracturing, after fracturing but before production flow, during production flow, etc. In other embodiments, a "multi-barrier" system may be provided that includes 2, 3, 4, 5, or more seals.

Figure 4:
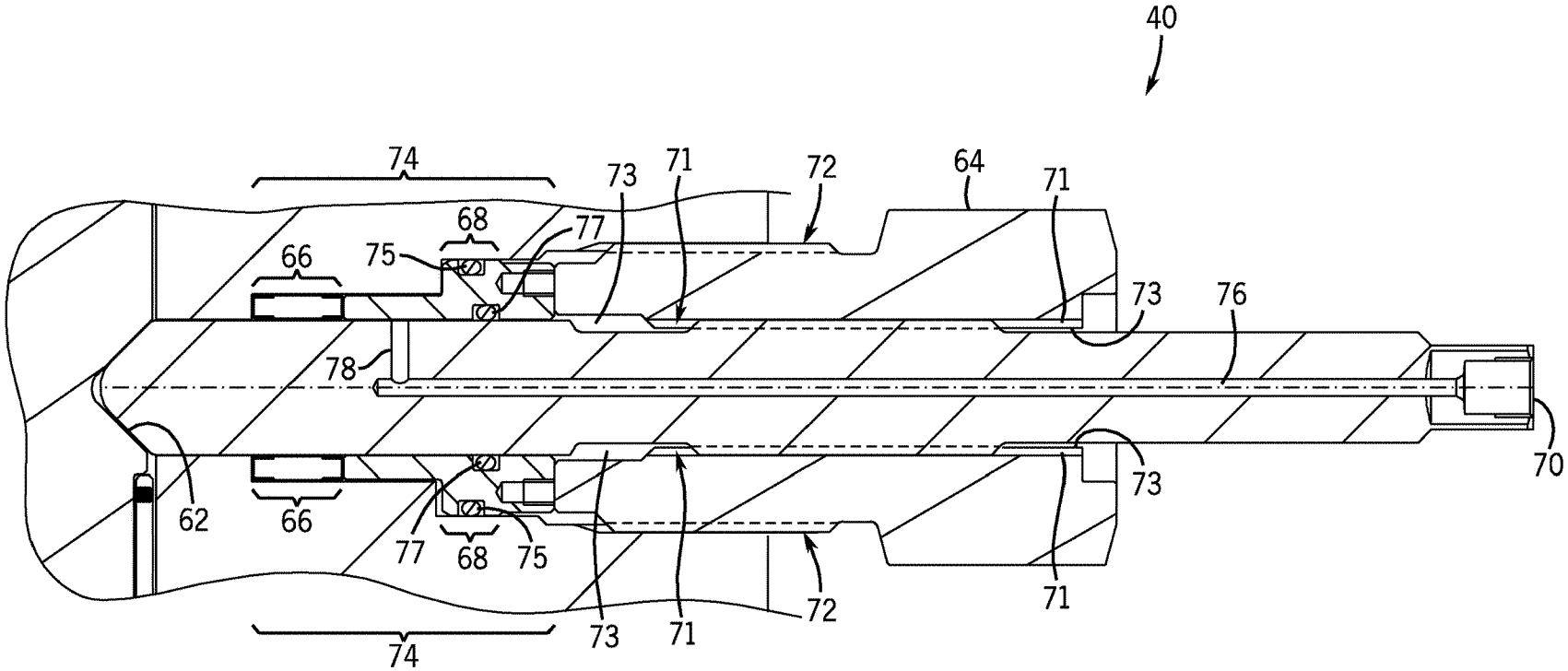
FIG. 4 is a cross-section of a dual barrier lock screw in accordance with an embodiment of the present invention.

FIG. 4 is a schematic view of the lock screw 40 in accordance with an embodiment of the present invention. As described above, to facilitate engagement with the tubing spool 24 or other component of the wellhead assembly 12, the lock screw 40 includes the gland 64 that may be configured to mate with recesses on the tubing spool 24 or other component of the wellhead assembly, such as via external threads 72 or other suitable structures. In such an embodiment, the lock screws 40 may be installed into the tubing spool 24 or other component of the wellhead assembly 40 by rotating the lock screw 40 into engagement via threads 72. The gland 64 may include internal threads 71 configured to mate with threads 73 on the exterior of the body of the screw 40. The illustrated lock screw 40 also includes the generally frustoconical distal portion 62 that contacts a recess of the tubing hanger 26. In other embodiments, the distal portion 62 may be any suitable topography configured to engage a similarly topographed recess on the tubing hanger 26 or other component of the wellhead assembly 12.

As mentioned above, the lock screw 40 includes the first seal 66 (e.g., annular seal) generally disposed around the circumference of the lock screw 40 in a first location along the length of the lock screw 40. The lock screw 40 also includes a second seal 68 (e.g., annular seal) disposed around the circumference of the lock screw 40 at a second location along the length of the lock screw 40. As illustrated in FIG. 4, the first seal 66 is directly about the body of the screw 40. The second seal 68 includes a first ring seal 75 about the gland 64 and a second ring seal 77 between the gland and the body of the screw 40.

Together, both the first seal 66 and the second seal 68 may be referred to as a dual barrier 74. The dual barrier 74 provides redundant sealing capability of the lock screw 40, e.g., providing a dual barrier capability throughout the life of the wellhead assembly 12. The seals 66 and 68 are energized upon insertion of the lock screw 40 into the tubing spool 24 or other component of the wellhead assembly 12, such as by turning the gland 64. Again, in other embodiments, a multi-barrier may be provided having 2, 3, 4, 5, 6, or more seals.

Additionally, as also described above, the lock screw 40 may include the test port 70 that provides the ability to test the dual barrier 74 of the lock screw 40. The test port 70 may connect to a passage 76 inside the lock screw 40. For example, as illustrated, the passage 76 may run axially along the length of the lock screw 40. The passage 40 may terminate at a point along the length of the screw 40, such as in the region 78 between the first seal 66 and the second seal 68, allowing testing of both seals 66 and 68. By providing pressure through the test port 70 and the passage 76, the dual barrier 74 of the lock screw 40 may be tested so that any failure of the first seal 66 or the second seal 68 results in a detectable pressure leak.

Figure 5:
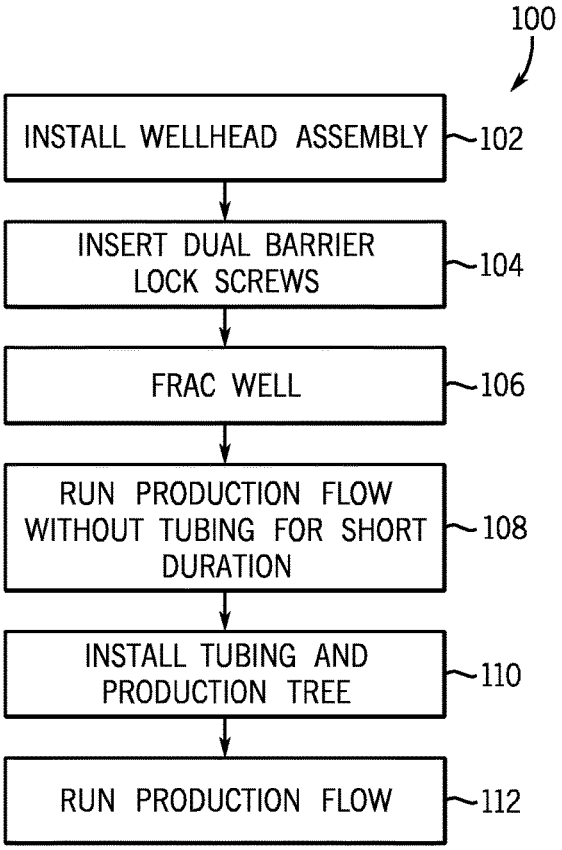
FIG. 5 is a flowchart of a process for operating a wellhead assembly having dual barrier lock screws in accordance with an embodiment of the present invention.
Figure 6:
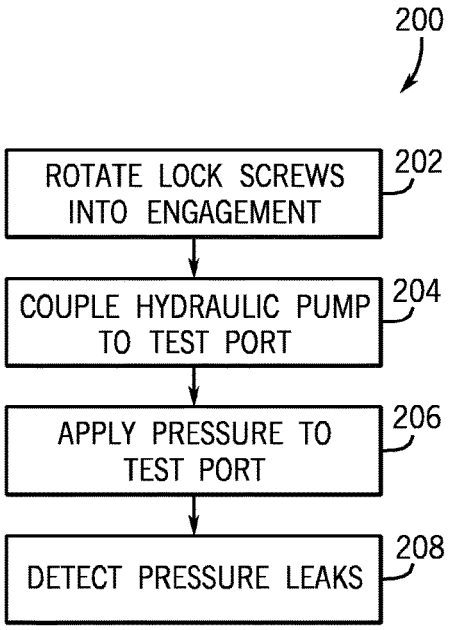
FIG. 6 is a flowchart of a process for testing a dual barrier lock screw and a wellhead assembly in accordance with an embodiment of the present invention.

FIG. 5 depicts a flowchart of a process 100 for operating a mineral extraction system 10 having dual barrier lock screws 40 in accordance with an embodiment of the present invention. Initially, the wellhead assembly 12 may be installed (block 102), including the various components described above, such as the wellhead hub 18, the casing spool 25, the tubing spool 24, etc. The dual barrier lock screws 40 are inserted into the wellhead assembly 12 (block 104), such as by rotating the lock screws 40 into threaded engagement with the tubing spool 24. In one embodiment, operation of the well may include fracturing rock formations in the well (block 106), which results in relatively high pressures in the wellhead assembly 12. After the fracturing process, a production flow may be run through the well without a tubing hanger 26, i.e., directly in the production casing, for a short duration (block 108). As explained above, the lock screws 40 provide a dual barrier during the fracturing process and any post-fracturing production flow, ensuring that redundant seals are provided to withstand the pressures reached during these operations. After the fracturing process and any post-fracturing production flow, the well may be plugged and production tubing and a production tree may be installed (block 110). As described above, the production tubing hanger 26 may be installed in full bore tension with the dual barrier provided by the lock screws 40. After the production equipment is installed, production flow is run through the wellhead assembly (block 112), and the lock screws 40 provide a dual barrier against any pressure leaks. Thus, at all modes of operation of the wellhead assembly 12, such as fracturing, post-fracturing flow, and production flow, a dual barrier is provided by the lock screws 40, FIG. 6 depicts a process 200 for testing the dual barrier lock screws 40 in accordance with an embodiment of the present invention. The lock screws 40 are first installed into the tubing spool 24 or other components of the wellhead assembly 12, such as by rotating the lock screws into threaded engagement (block 202). The lock screws 40 may be tested with a tubing hanger 26 and tubing in the wellhead assembly 12, or may be tested without these components. A hydraulic pump or other source of pressure is coupled to the test ports 70 of the lock screws 40 (block 204) to provide pressure. Because each lock screw 40 has its own test port 70, each lock screw may be individually tested. Any other suitable pressure source may be used. Pressure may be applied to the test port 70 (block 206) and may be gradually increased to reach the desired testing threshold. Additionally, any pressure leaks may be detected to determine points of failure and verify the integrity of the dual barrier seals of the lock screw 40 (block 208). Advantageously, use of the test ports 70 allows testing of the dual barrier with the lock screws 40 installed in the wellhead assembly 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a multi-barrier lock screw comprising a body, a tip portion fixed to the body and extending to a distal end along an axis of the body, a plurality of annular seals at different axial locations about the body, external threads about the body, an external port, and a pressure test passage in the body leading from the external port to a testing region adjacent the plurality of annular seals, wherein the pressure test passage terminates at a distance away from the tip portion such that the tip portion is closed to the pressure test passage, wherein the multi-barrier lock screw is configured to provide a multi-barrier of protection against pressures in a mineral extraction system via the plurality of annular seals, wherein the multi-barrier lock screw comprises at least one of:

the tip portion comprises a frustoconical end;

the tip portion is fixed to the body as a one-piece structure;

the tip portion is configured to rotate into a locking position;

the tip portion is configured to be mechanically driven into the locking position; or the plurality of annular seals comprises a first seal disposed about the body, a second seal disposed between the body and a gland, and a third seal disposed about the gland.

2. The system of claim 1, wherein the multi-barrier lock screw comprises a gland comprising internal threads and external threads.

3. The system of claim 1, wherein the tip portion comprises the frustoconical end.

4. The system of claim 1, comprising first and second tubular components of the mineral extraction system coupled together via the multi-barrier lock screw, wherein the body is configured to screw through the first tubular component crosswise to a central axis of the first tubular component, the tip portion selectively engages a recess in a circumference of the second tubular component, and the first and second tubular components are coaxial with one another.

5. The system of claim 1, wherein the plurality of annular seals comprises:

the first seal disposed about the body;

the second seal disposed between the body and the gland;

the third seal disposed about the gland.

6. The system of claim 1, comprising a hanger, wherein the multi-barrier lock screw is configured to move along threads in a direction crosswise to a central axis of the hanger to engage a surface of the hanger to block movement of the hanger in the mineral extraction system.

7. The system of claim 1, wherein the tip portion is fixed to the body as the one-piece structure.

8. The system of claim 1, wherein the tip portion is configured to rotate into the locking position.

9. The system of claim 1, wherein the tip portion is configured to be mechanically driven into the locking position.

10. An assembly, comprising:

a lock screw, comprising:

a body extending along an axis from a first end to a second end, wherein the second end has a tapered tip portion fixed to the body, the tapered tip portion is closed to block passage of a fluid, the body comprises threads coaxial with the axis, the body is configured to screw through a first component of a wellhead assembly crosswise to a central axis of the first component, and the tapered tip portion is configured to selectively engage a recess in a circumference of a second component of the wellhead assembly to block movement of the second component relative to the first component;

a first seal disposed at a first axial location on the body and configured to seal the body to the first component of the wellhead assembly; and a second seal disposed at a second axial location on the body and configured to seal the body to the first component of the wellhead assembly, wherein the first and second axial locations are different from one another, wherein the lock screw comprises at least one of:

the tapered tip portion comprises a frustoconical end, wherein the tapered tip portion is fixed to the body as a one-piece structure;

a gland, wherein the gland comprises mating threads coupled to the threads of the body and external threads configured to mate to the first component of the wellhead assembly, and the body is configured to screw through the gland in the first component in the crosswise direction relative to the central axis of the first component; or the gland, wherein the second seal comprises a first ring seal configured to seal the body to the gland and a second ring seal configured to seal the gland to the first component of the wellhead assembly, the first ring seal is disposed in an inner groove of the gland facing the body, and the second ring seal is disposed in an outer groove of the gland facing the first component of the wellhead assembly.

11. The assembly of claim 10, comprising a pressure test passage extending through the body from an external port to a testing region, wherein the pressure test passage is configured to apply pressure to the testing region to test an integrity of the first seal, the second seal, or a combination thereof, wherein the pressure test passage terminates at a distance away from the tapered tip portion such that the tapered tip portion is closed to the pressure test passage.

12. The assembly of claim 10, comprising the gland, wherein the gland comprises the mating threads coupled to the threads of the body and the external threads configured to mate to the first component of the wellhead assembly, wherein the body is configured to screw through the gland in the first component in the crosswise direction relative to the central axis of the first component.

13. The assembly of claim 10, wherein the tapered tip portion comprises the frustoconical end, and the tapered tip portion is fixed to the body as the one-piece structure.

14. The assembly of claim 10, comprising the first and second components of the wellhead assembly, wherein the first and second components are coaxial, and the second component comprises a hanger.

15. The assembly of claim 10, comprising the gland, wherein the second seal comprises the first ring seal configured to seal the body to the gland and the second ring seal configured to seal the gland to the first component of the wellhead assembly, the first ring seal is disposed in the inner groove of the gland facing the body, and the second ring seal is disposed in the outer groove of the gland facing the first component of the wellhead assembly.

16. A lock screw for a wellhead assembly, comprising:

a body extending along an axis from a first end to a second end, wherein the second end has a tip portion fixed to the body, the body is configured to screw through a first component of the wellhead assembly in a crosswise direction relative to a central axis of the first component, and the tip portion is configured to selectively engage a recess in a second component of the wellhead assembly to block movement of the second component relative to the first component; and a passage extending through the body from an external port to a testing region, wherein the passage is configured to supply pressure from the external port to the testing region to test an integrity of at least one component of the wellhead assembly, wherein the passage terminates at a distance away from the tip portion such that the tip portion is closed to the passage, wherein the lock screw comprises at least one of:

the tip portion comprises a tapered tip portion fixed to the body as a one-piece structure;

a gland, wherein the gland comprises first internal threads and second external threads, the first internal threads are coupled to first external threads of the body, the second external threads are configured to mate to second internal threads of the first component of the wellhead assembly, and the body is configured to screw through the gland in the first component in the crosswise direction relative to the central axis of the first component; or the gland, wherein the second seal comprises a first ring seal configured to seal the body to the gland and a second ring seal configured to seal the gland to the first component of the wellhead assembly, the first ring seal is disposed in an inner groove of the gland facing the body, and the second ring seal is disposed in an outer groove of the gland facing the first component of the wellhead assembly.

17. The lock screw of claim 16, wherein the external port is disposed at an end portion of the body, and the passage includes an axial passage and a radial passage.

18. The lock screw of claim 16, comprising a first seal disposed at a first axial location on the body and configured to seal the body to the first component of the wellhead assembly.

19. The lock screw of claim 18, comprising a second seal disposed at a second axial location on the body and configured to seal the body to the first component of the wellhead assembly.

20. The lock screw of claim 19, comprising the gland, wherein the second seal comprises the first ring seal configured to seal the body to the gland and the second ring seal configured to seal the gland to the first component of the wellhead assembly, the first ring seal is disposed in the inner groove of the gland facing the body, and the second ring seal is disposed in the outer groove of the gland facing the first component of the wellhead assembly.

21. The lock screw of claim 19, wherein the passage is configured to apply the pressure to the testing region to test the integrity of the first seal, the second seal, or a combination thereof.

22. The lock screw of claim 16, comprising the gland, wherein the gland comprises the first internal threads and the second external threads, the first internal threads are coupled to the first external threads of the body, the second external threads are configured to mate to the second internal threads of the first component of the wellhead assembly, and the body is configured to screw through the gland in the first component in the crosswise direction relative to the central axis of the first component.

23. The lock screw of claim 16, wherein the tip portion comprises the tapered tip portion fixed to the body as the one-piece structure.

24. The lock screw of claim 16, wherein the second component comprises a hanger.

25. A method of testing a wellhead assembly, comprising:

applying external pressure to a port of a lock screw to apply pressure to a testing region to test an integrity of at least one component of the wellhead assembly, wherein the lock screw comprises:

a body extending through a first component of the wellhead assembly crosswise to a central axis of the first component, wherein the lock screw has a tip portion fixed to the body, and the tip portion selectively engages a recess in a second component disposed inside of the first component of the wellhead assembly to block movement of the second component relative to the first component; and a passage extending axially through the body between the port and the testing region, wherein the passage terminates at a distance away from the tip portion such that the tip portion is closed to the passage, wherein the tip portion is fixed to the body as a one-piece structure.

26. The method of claim 25, wherein the at least one component comprises one or more seals.

27. The method of claim 25, wherein the testing region is disposed between first and second seals extending circumferentially around the body of the lock screw.

28. A method of operating a wellhead assembly, comprising:

installing one or more lock screws into the wellhead assembly to couple a first component to a second component, wherein each of the one or more lock screws comprises:

a body extending through the first component in a crosswise direction relative to a central axis of the first component, wherein the lock screw has a tip portion fixed to the body, and the tip portion selectively engages a recess in a circumference of the second component disposed inside of the first component;

a first seal disposed at a first axial location on the body and configured to seal the body to the first component of the wellhead assembly;

a second seal disposed at a second axial location on the body and configured to seal the body to the first component of the wellhead assembly; and a pressure test passage extending through the body to a region configured to test integrity of the first seal, the second seal, or a combination thereof, wherein the pressure test passage terminates at a distance away from the tip portion such that the tip portion is closed to the pressure test passage, wherein the tip portion is fixed to the body as a one-piece structure.

29. The method of claim 28, wherein the region is disposed between the first and second seals.

30. The method of claim 28, wherein the second component comprises a hanger.

31. The method of claim 30, wherein installing comprises threading the body of each lock screw of the one or more lock screws through the first component to engage the tip portion against the recess in the circumference of the hanger.

32. A mineral extraction system, comprising:

a wellhead assembly comprising first and second components disposed coaxial with one another; and one or more lock screws coupling together the first and second components, wherein each of the one or more lock screws comprises:

a body extending through the first component, wherein the lock screw has a tip portion fixed to the body, and the tip portion selectively engages a recess in the second component in response to screwing the lock screw along threads;

a first seal disposed at a first location on the body and configured to seal the body to the first component of the wellhead assembly;

a second seal disposed at a second location on the body and configured to seal the body to the first component of the wellhead assembly;

a port at the first end of the body configured to receive pressure external from the wellhead assembly; and a pressure test passage extending through the body to a region configured to test integrity of the first seal, the second seal, or a combination thereof, wherein the pressure test passage terminates at a distance away from the tip portion such that the tip portion is closed to the pressure test passage, wherein the tip portion comprises a tapered tip portion fixed to the body as a one-piece structure.

33. The system of claim 32, wherein the region is disposed between the first and second seals.

34. A wellhead assembly, comprising:

a spool;

a hanger disposed in the spool; and one or more lock screws coupling together the spool and the hanger, wherein each of the one or more lock screws comprises:

a body extending through the spool, wherein the lock screw has a tip portion fixed to the body, and the tip portion selectively engages a recess in the hanger in response to screwing the lock screw along threads;

a plurality of seals disposed about the body at different axial positions; and a pressure test passage leading from an external port to a region between the plurality of seals, wherein the pressure test passage terminates at a distance away from the tip portion such that the tip portion is closed to the pressure test passage, wherein the tip portion comprises a tapered tip portion fixed to the body as a one-piece structure.

* * * * *